United States Patent [19]

Best

[11] 4,055,973

[45] Nov. 1, 1977

[54] EQUIPMENT LOCK

[76] Inventor: Walter E. Best, c/o Best Lock Corporation, P.O. Box 103, Indianapolis, Ind. 46206

[21] Appl. No.: 666,048

[22] Filed: Mar. 11, 1976

[51] Int. Cl.[2] ..... E05B 73/00

[52] U.S. Cl. ..... 70/58; 70/18; 70/371; 70/DIG. 57

[58] Field of Search ..... 70/15, 18, 57, 58, 59, 70/61, 62, 371, DIG. 57; 248/203; 211/4

[56] References Cited

U.S. PATENT DOCUMENTS

| | | | |
|---|---|---|---|
| 1,800,943 | 4/1931 | Junkune | 70/18 X |
| 2,996,909 | 8/1961 | Raye | 70/57 |
| 3,211,408 | 10/1965 | Schaefer | 70/58 X |
| 3,690,130 | 9/1972 | Eutzler | 70/18 |
| 3,771,338 | 11/1973 | Raskin | 70/58 |
| 3,808,847 | 5/1974 | Vesely | 70/18 |
| 3,928,990 | 12/1975 | Stenz | 70/58 |

*Primary Examiner*—Robert L. Wolfe
*Attorney, Agent, or Firm*—Jenkins, Coffey & Hyland

[57] ABSTRACT

To prevent removal of laboratory or office equipment and the like, separate cables are attached to four or more items of such equipment and have circumferentially-grooved end members which are received in separate bores in a single lock body and are locked therein by a key-controlled keeper. Preferably, the keeper is a key-removable core inserted in a core chamber which partially intersects the cable-receiving bores, so that the core itself engages in the grooves of the cable end members to lock them against retraction. A mounting screw access passage traverses the core chamber, and is blocked by the core in such chamber to prevent access to a mounting screw inserted through such passage. In a modification, six cable-end receiving bores are circumferentially spaced about the lock body in a common plane. A rotatable keeper plate is mounted in the lock body in a parallel plane and has keeper lugs to engage cable end members inserted in such bores. A key-removable core blocks access to a mounting screw and operates as a lock to actuate the keeper plate.

17 Claims, 16 Drawing Figures

EQUIPMENT LOCK

SUMMARY OF THE INVENTION

This invention relates to locking mechanism for securing against removal various items of equipment, for example, laboratory equipment such as microscopes, office equipment such as typewriters and calculating machines, and various other equipment which is desirably movable to a limited extent for convenience but needs to be secured against removal. The present invention provides means for securing several such items by cables to a single key-controlled locking device. Such device may be mounted to a support by a mounting screw which is concealed and rendered inaccessible by the key controlled mechanism of such device.

In accordance with the invention, a plurality of separate cables, preferably four or more, are respectively secured against separation from a plurality of items of equipment, as by being attached to, passed through, or otherwise connected with the several items. The cables have end members shaped for engagement in a locking device, and such end members are secured in separate receptacles in a lock body by a key-controlled keeper. Preferably, the cable end members are circumferentially grooved prongs received in separate bores in the body, and the keeper is a key-removable core inserted in a core chamber which is partially intersected by the cable-receiving bores, so that the core itself engages in the grooves of the cable end members to lock them in place. Four or more of such cable ends can be locked in the same lock body by a single available and standard key-removable core. A mounting screw access hole desirably traverse the core chamber so that the core in the chamber also blocks access to a lock-body mounting screw inserted through such hole. As a modification, the key-removable core, instead of serving itself as the keeper, is operable to actuate a separate keeper movably mounted in the lock body and arranged to engage with several cable end members. In such case, the core may be removable only to provide access to a mounting screw. In some circumstances, as where one or more cables attached to separate pieces of equipment are passed through openings in a supporting table, the lock body need not itself be fixed to a support.

BRIEF DESCRIPTION OF THE DRAWINGS

The accompanying drawings illustrate the invention and show preferred embodiments thereof. In such drawings.

DESCRIPTION OF PREFERRED EMBODIMENT

Figure 1:
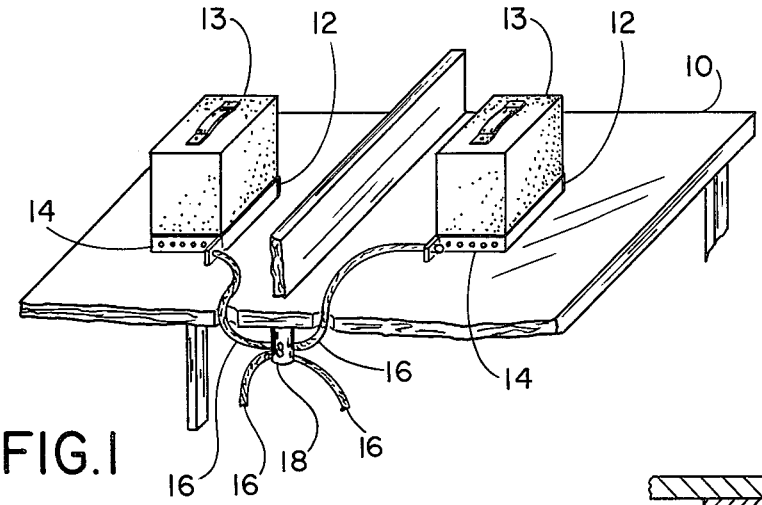
FIG. 1 is a diagrammatic view showing a portion of a laboratory table with two items of laboratory equipment secured thereon by a locking mechanism in accordance with the invention.

The apparatus shown in FIG. 1 exemplifies the utility of the present invention, and comprises a table 10 having two workspaces each supporting an item of laboratory equipment, such as a microscope 12, shown enclosed in a housing 13 and having a securing plate 14 attached to its base. Each securing plate 14 is connected to a cable 16, and the two cables extend through holes in the table top and have their ends secured in a lock body 18 in accordance with the present invention. Two additional cables 16 are shown connected to the lock body 18 for securing two other items of equipment, not shown.

Figure 7:
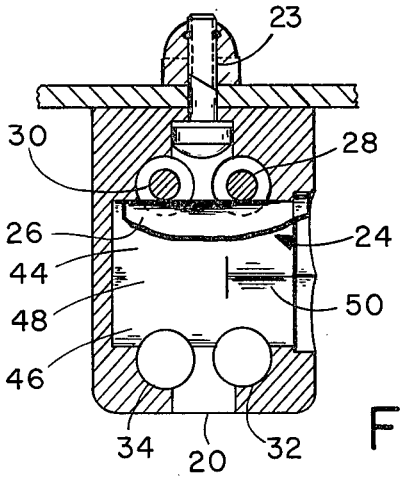
FIG. 7 is a transverse section taken on the line 7—7 of FIG. 4, but showing the lock body bolted to a metal wall.
Figure 2:
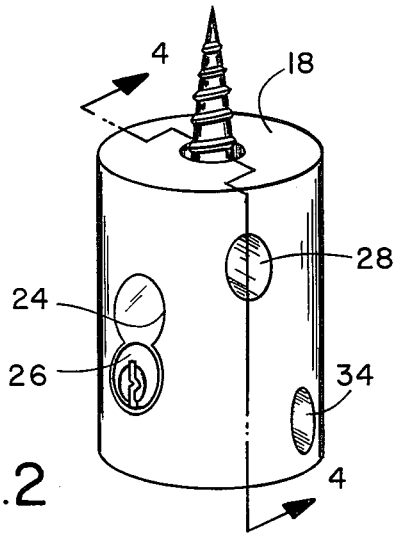
FIG. 2 is a perspective view of a lock body in accordance with the invention, containing a key-removable core; and having a wood screw in its mounting hole.

In the preferred embodiment shown in FIGS. 2–7, the lock body 18 is a generally cylindrical body having an axial mounting hole 20, reduced at one end, for the reception of a mounting element shown as a screw 22 in FIG. 2 and as a bolt 23 in FIG. 7. The body also has a diametrically disposed lock core chamber 24 for the reception of a lock core 26 which, when in place, extends across the mounting hole 20 so as to block access to the screw 22 (FIG. 4) or the bolt 23 (FIG. 7). The lock body 18 also contains four chordally disposed blind bores 28, 30, 32, and 34 perpendicular to the plane of the core chamber 24. These are arranged in upper and lower pairs and are interrelated with the lock core chamber 24 so as to partially intersect that chamber so that a core in the chamber 24 will partially block the bores and block retration of suitably formed cable end members from the cable receiving bores 28–34.

Figure 3:
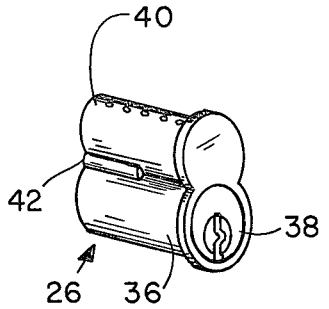
FIG. 3 is a perspective view of a known key-removable core desirably used in the lock body of FIG. 2.

The preferred lock core 26 shown in FIG. 3 is of the type shown, for example, in FIGS. 1–9 of Frank E. Best U.S. Pat. No. 3,206,959. Such core is of figure-8 cross section and is formed of a lower cylindrical lobe 36 which houses a rotatable key plug 38, and an upper cylindrical lobe 40 which houses a series of tumbler pins. A retaining lug 42 projects from the side of the core 26 at the rear and is retractable by use of an appropriate key in the key plug 38 to permit insertion and removal of the core from a suitably shaped chamber 24. The chamber 24 is formed by boring two spaced overlapping bores 44 and 46, and by subsequently milling away portions of the longitudinal ribs between the bores to form flat sides 48 at the inner end of the cavity 24, but to leave inwardly projecting lugs 50 adjacent the outer end of the cavity, behind which the retaining lug 42 of the core 26 may be engaged to retain the core in place.

Figure 5:
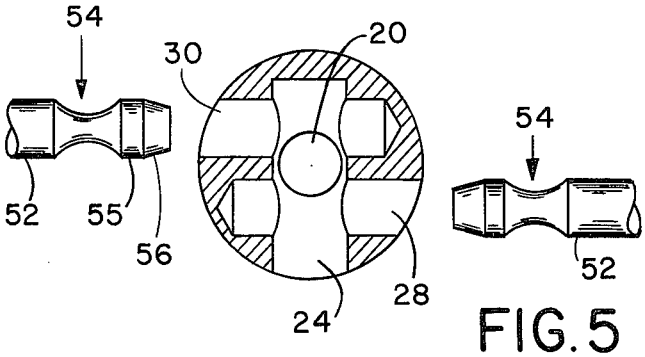
FIG. 5 is a horizontal section taken on the line 5—5 of FIG. 4, with two cable end members shown in exploded relation therewith.
Figure 4:
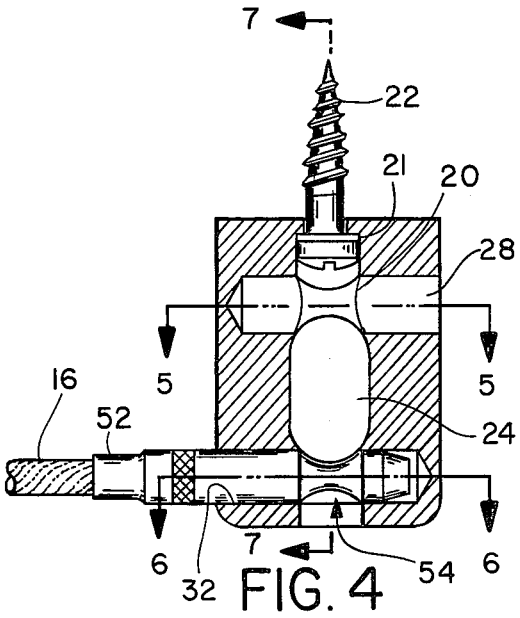
FIG. 4 is a section generally on the line 4—4 of FIG. 2, but with an upper portion broken away to show the mounting screw on the axis of the body.
Figure 6:
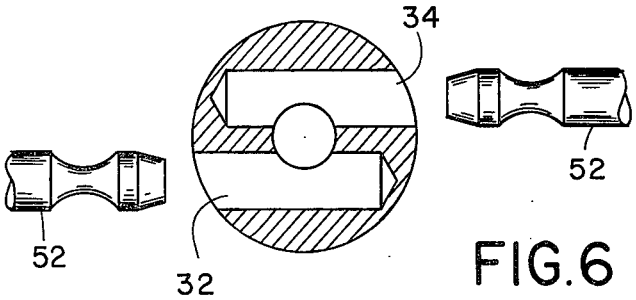
FIG. 6 is a section taken on the line 6—6 of FIG. 4, with two other cable end members shown in exploded relation therewith.
Figure 12:
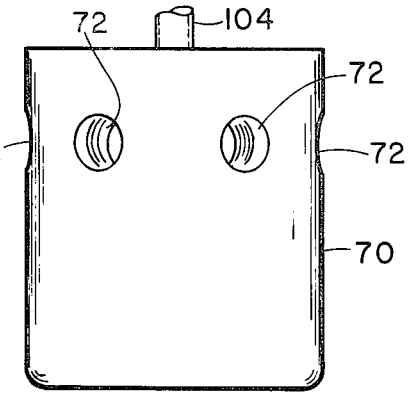
FIG. 12 is a side elevation of a modified lock mechanism, having receptable bores for six cable ends.

As shown in FIGS. 4–6, each cable 16 carries a prong-like end member 52, swaged or otherwise securely fixed to the end of the cable, and shaped to be inserted and locked in one of the cable receiving bores 28–34 of the lock body 18. When the preferred core 26 is used to retain the cable end members 52 in place, such members are desirably formed with a circumferential groove 54 of arcuate shape matching the cylindrical surfaces of the two lobes 36 and 40 of the core 26. The forward ends of the cable end members, forwardly of the circumferential grooves 54, are desirably formed with a cylindrical band 55 and a tapered nose portion 56, to facilitate insertion and removal of the cable end members from the bores 28–34. When the end members have cirumferential grooves 54,as shown, such end members are freely rotatable in the lock body when secured in place, and this is considered convenient and desirable. Alternatively the end members may be notched at only one side with a notch shaped to fit the retaining core 26, and while in such case the notch may be deeper, the end members are not freely rotatable and this is less convenient and desirable.

As shown in FIGS. 5 and 6, the upper pair of cable-receiving bores 28 and 30 are disposed on opposite sides of the axis of the body 18 and open in opposite directions, while the lower pair of cable-receiving bores 32 and 34 are likewise disposed on opposite sides of the axis and open in directions opposite to each other and opposite to the respective overlying bores 28 and 30. This provides a hole pattern as shown in FIG. 2, in which the holes 28 and 34 opening at one side of the lock body 18 are offset both laterally and vertically from each other, and the holes 30 and 32 opening at the opposite side of the body are similarly offset from each other.

To permit inserting the cable ends 52 into the cable-receiving bores 28–30, the lock core 26 is actuated by an appropriate key to retract the lug 42, and the core 26 is removed from the body 18. The cable ends 52 are then inserted in the cable-receiving bores so as to bring their notches 54 into registry with the sides of the core chamber 24, and the core 26 is then reinserted in the body 18 and the retaining lug 42 projected to its locking position so as to lock the core in place in the body 18. The two lobes of the core will then lie in the grooves 54 of the cable end members 52, to securely lock those cable end members in the body 18 and block their removal.

Figure 8:
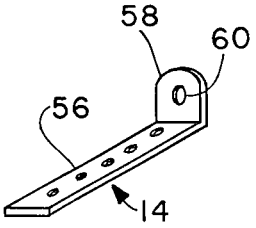
FIG. 8 is an isometric view of a bracket adapted for mounting on an item of equipment to be secured.
Figure 10:
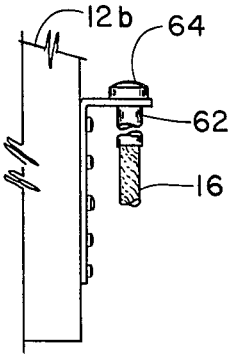
FIG. 10 is an elevation showing a bracket of FIG. 8 secured to the face of a pedestal or base of an item of equipment and engaged with a headed cable end.
Figure 14:
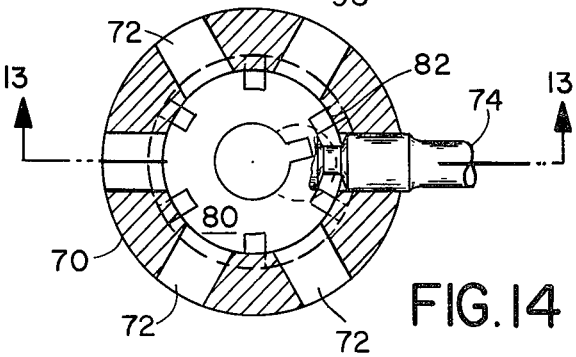
FIG. 14 is a section taken on the line 14—14 of FIG. 13, showing the keeper member in elevation.
Figure 11:
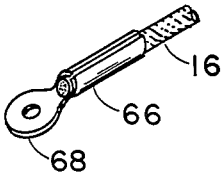
FIG. 11 is an isometric view of a modified cable end for use in attaching a securing cable to a piece of equipment.
Figure 15:
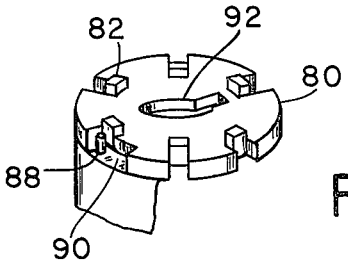
FIG. 15 is a perspective view of the keeper member.
Figure 9:
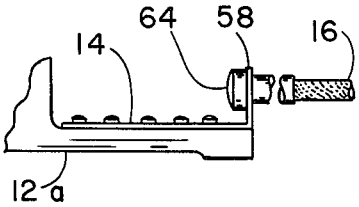
FIG. 9 is a side elevation showing such bracket secured to the base of an item of equipment and engaged with the headed end of a securing cable.
Figure 16:
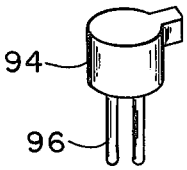
FIG. 16 is an isometric view of a throw member for connecting the key plug of a lock core to the keeper member.

The cables 16 are secured against separation from the items of equipment which it is desired to secure against removal. This may be done in various ways, for example, by connecting the opposite ends of the cables to the equipment, by passing the cables through openings in the equipment, etc. For convenience, I provide securing plates 14 as shown in FIG. 8 which may be fixed on the equipment and retain the opposite ends of the cables. These consist of a flat base portion 56 having a series of several holes therein which may be used together or selectively to fix the plate 14 to an item of equipment to be secured. The plate has an upstanding end arm 58 containing a hole 60 to pass a cable 16 and its end member 52. The opposite end of the cable 16 is fixed in a headed member 62 having a shank swaged or otherwise fixed to the cable end and adapted to pass through the hole 60 and having an enlarged head 64 which secures the cable against removal from the plate. As shown in FIG. 9, the securing plate may be mounted horizontally on the base 12*a* of an item of equipment, or as shown in FIG. 10 may be mounted edgewise or vertically against the face of an item 12*b* of equipment. Alternatively, the cable may be passed through a suitable hole in the frame or base of the equipment itself so as to be retained by the head 64. Also, as shown in FIG. 11, the cable 16 may carry an end member 66 formed with an eye 68 which can be bolted or otherwise secured to the equipment. Further, a cable may be threaded through an item and both ends secured to the lock body by end members 52.

General operation of this modification of FIGS. 2–7 is as follows. Up to four cables 16 are suitably attached to items of equipment which are to be secured, and the cables are lead to the lock body, 18, as through holes in the supporting table 10. With a suitable key inserted in the key slot of the core 26, the retaining lug 42 is retracted and the core 26 is withdrawn from the lock body 18. The cable end members 52 are inserted in the cable-receiving bores 28–34 of the lock body 18, and the core 26 is then reinserted in the chamber 24. Portions of the two lobes 36 and 40 of the core enter the circumferential notches 54 of the four cable end members 52 to secure them against withdrawal. The key of the core 26 is then manipulated to project the retaining lug 42 to a position behind the retaining lug 50 of the core chamber 24, and the key is then withdrawn. This leaves the core 26 locked in place in engagement with the grooves 54 of the cable end members 52 so as to secure those cable end members in the bores of the lock body 18.

The modification shown in FIGS. 12–16 comprises a body 70 having six circumferentially-spaced, radially-disposed coplanar bores 72 for the reception of six cable end members 74. The body 70 is formed with a large cylindrical chamber 76 which terminates at an end shoulder 78 coplanar with the bottom edges of the bores 72, and which is open to a smaller diameter bore 79 which extends to the plane of the upper edges of such bores 72. A keeper plate 80 is mounted against the shoulder 78 and has six circumferentially-spaced upturned keeper lugs 82 which project into the smaller diameter bore 79. These upturned keeper lugs 82 have an unlocked position shown in FIG. 14 in which they lie between the cable-receiving bores 72, and are movable therefrom to a locked position shown in FIG. 13 where they lie at the centers of the bores 72 for purposes of retaining the cable end members 74 therein. For engagement by such lugs, the cable and members 74 are formed with circumferential grooves 84 of a width to receive the lugs 82.

A lock cylinder 86 is mounted in the chamber 76 with its end face bearing against the bottom face of the keeper plate 80. In order to limit the throw of such plate, the lock cylinder 86 may carry a pin 88 engaged in a peripheral notch 90 in the keeper plate 80. The cylinder 86 is formed with a core-receiving chamber 98 of the same configuration as that shown in FIGS, 2–7 and including a projecting lug 100 for retaining a core 26 in place.

For purposes of rotating the keeper 80 between its locked and unlocked position, it is provided with a non-circular central opening 92, here shown as of keyhole shape, which receives the corresponding shaped upper end of a throw member 94 which is rotatably mounted in the cylinder 86 at the rear end of the chamber 98. The throw member has a pair of depending legs 96 adapted to enter corresponding holes in the rear of the key plug 38 of a core 26 mounted in the chamber 98.

In this modification of FIGS. 12–16, up to six end members 74 on cables 16 may be inserted in the radial bores 72 of the lock body 70. The chamber 98 contains a key-removable lock core 26 as shown in FIG. 3, and the relationship of the keeper plate 80 to the key plug 38 of the lock core is such that the keeper lugs 82 are in their locked position shown in FIG. 13 when the key plug is in its locked position for removal of the operating key from the key slot therein, and are turned to their unlocked position shown in FIG. 14 by rotation of the key plug 38 with a suitable operating key. Locking and release of the cable end members 74 in the body 70 is effected by the usual key rotation of the key plug 38 of the core, instead of by the insertion and removal of the core in the chamber 24 as in FIGS. 2–7.

For mounting the lock body 70 to a suitable support, the upper end of the body 70 is formed with a shouldered bore 102 for the reception of a mounting screw or bolt 104. This is aligned with the central hole 92 of the keeper plate 80 and access to it is obtained by removing the core from the core-receiving chamber 98 with the use of a special control key, and removing the throw member 94, so as to provide a clear passage through the chamber 98, the bore in the end wall of the cylinder 86, and the hole 92 in the keeper plate 80.

Figure 13:
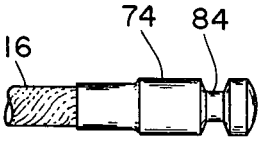
FIG. 13 is a vertical section of the lock body shown in FIG. 12, shown with two cable end members related thereto.
Figure 13:
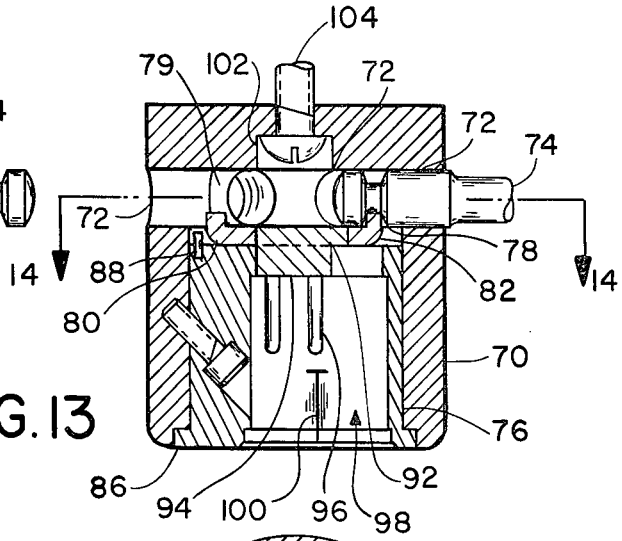

The overall operation of this modification is as follows. The core 26 is removed from the chamber 98 in the cylinder 86, by use of a special control key which acts to retract the retaining lug 42, and the throw member is removed, which opens a screw access passage through the chamber 86 and the keeper 80. The lock body 70 is then suitably mounted against a support by inserting and driving a screw 104 through such passage. The throw member 94 and core 26 are then re-inserted in the cylinder 86 and the core is locked in place and the special control key is withdrawn. An operating key is then inserted, and the keeper plate 80 is turned on its unlocked position by manipulation of such operating key. Up to six cables 16 are attached to items of equipment desired to be secured against removal, and the cables are lead to the lock body 70 and their end members 74 are inserted in the six radial cable-receiving bores 72. When the cable end members 74 are all inserted, the operating key of the core 26 is then manipulated to rotate the keeper plate 80 to its locked position as shown in FIG. 13. This carries the keeper lugs 82 into the circumferential slots 84 of the end members, to secure them in place in the lock body. The operating key is then removed, leaving the cable ends locked in place and the items of equipment secured against removal.

I claim:

1. An equipment lock, comprising a plurality of cables adapted to be secured respectively against separation from a plurality of items of equipment and each having a cable end member shaped for engagement in a locking device, a lock body having a plurality of spaced receptacles for said cable end members, and having a mounting chamber within the body for the reception of keeper means, and keeper means having a keeping position mounted in said chamber in which it interengages the cable end members received in said receptacles to secure the same against removal from the lock body, said keeper means being movable from said keeping position to release the cable end members for such removal, and key-operated locking means which in the keeping position of the keeper means is contained within the body and locks said keeper means in said keeping position and which is operable to release the keeper means for movement to release the cable end members.

2. An equipment lock, comprising a plurality of cables adapted to be secured respectively against separation from a plurality of items of equipment and each having a cable end member shaped for engagement in a locking device, said cable end members being in the form of laterally grooved prongs, a lock body having a plurality of spaced receptacles for said cable end members, said receptacles being in the form of bores in the lock body shaped to receive said prongs, keeper means having a keeping position relative to said receptacles in which it interengages the cable end members to secure the same against removal from the lock body, said keeper means including blocker portions which in the keeper position of the keeper means interengage the grooves in said prongs to block their removal from the bores, and said keeper means being movable from said position to release the cable end members for such removal, and locking means for locking said keeper means in said securing position and operable to release the keeper means for movement to release the cable end members.

3. An equipment lock as in claim 2 in which said cable end members are circumferentially grooved cylindrical members which fit in said bores in any rotational orientation and are rotatable therein when engaged by said keeper means.

4. An equipment lock as in claim 2 in which said lock body is formed with a core-receiving chamber adapted to have a key-removable core mounted therein, said receptacles are bores which partially intersect said core-receiving chamber, and said cable end members are shaped to be interengaged by a core mounted in said chamber to secure such members in place, said core being key-removable from the chamber to release the cable end member from the lock body.

5. An equipment lock as in claim 4 in which two laterally spaced receptacle bores intersect the same side of the core-receiving chamber and open for reception of cable end members from opposite directions.

6. An equipment lock as in claim 5 in which two other laterally spaced receptacle bores intersect the opposite side of the core-receiving chamber and open for reception of cable end members from opposite directions.

7. An equipment lock as in claim 6 in which said key-removable core has a first lobe containing a rotatable key plug and has a second lobe containing tumbler pins, said first two receptacle bores are positioned to intersect one of said lobes and the second two receptacle bores are positioned to intersect the second lobe.

8. An equipment lock as in claim 7 in which the lobes of said key-removable core are both cylindrical, and the cable end members are formed with circumferential grooves mating with the cylindrical surfaces of said lobes.

9. An equipment lock as in claim 4 in which said core-receiving chamber comprises a pair of spaced overlapping cylindrical bores, and said plurality of receptacle bores extend transversely of and partially intersect said chamber bores.

10. An equipment lock as in claim 4 in which said lock body includes a mounting-screw access hole which traverses said core-receiving chamber and is blocked when a core is mounted in such chamber.

11. An equipment lock as in claim 8 in which said lock body includes a mounting-screw access hole which traverses said core-receiving chamber and is blocked when a core is mounted in such chamber.

12. An equipment lock comprising a plurality of cables adapted to be secured respectively against separation from a plurality of items to be secured against removal, each cable having an end member shaped for insertion in a locking device, a lock body having a core chamber for the reception of a key-removable core, a plurality of cable-receiving bores crossing and partially intersecting said core chamber, said cable ends being shaped for insertion in said bores and to be blocked from removal therefrom by engagement with a core mounted in said chamber, and a core mounted in said chamber and having key-actuated means for locking the core in said chamber to lock the cable ends against removal and for releasing the core for removal from the chamber to release the cable ends for removal from the cable-receiving bores.

13. An equipment lock as in claim 2 in which said keeper means comprises a keeper member mounted in said lock body for movement between a keeper position and a release position, and said locking means comprises a key-actuated lock mechanism mounted in said lock body and connected to move said keeper member between its two positions.

14. An equipment lock as in claim 13 in which said receptacle bores are arranged in circumferentially-spaced, coplanar relation in said lock body, said keeper member is mounted for rotation in a plane parallel to the plane of said boxes and includes circumferentially-spaced keeper lugs which lie in said bores to retain cable end members therein when the keeper member is in its keeper position.

15. An equipment lock as in claim 14 in which said lock body contains an axial bore normal to the plane of said receptacle bores, said keeper member is mounted for rotation at the end of said axial bore and carries upstanding keeper lugs, a lock cylinder mounted in said axial bore and retaining said keeper member in mounted position, said key-actuated lock mechanism being mounted in said cylinder and including a throw member operatively connected to said keeper member.

16. An equipment lock as in claim 15 in which said key-actuated lock mechanism is a key-removable core, and such core and said throw member are removable to open an axially extending passage through the cylinder and keeper member, and a mounting screw or the like mounted at the end of said passage and accessible therethrough, said core serving to block access to said screw when mounted in the cylinder.

17. An equipment lock, comprising a plurality of cables adapted to be secured respectively against separation from a plurality of items to be secured against removal, each cable having an end member shaped for insertion in a locking device, a lock body having a plurality of cable-receiving bores in circumferentially spaced relation therein, a keeper member mounted for rotation in said body between a keeper position and a release position, said cable end members having lateral cavities therein and said keeper member having keeper lugs thereon which engage in said cavities to retain the end members against retraction when the keeper member is in its keeper position, and a locking mechanism mounted in said lock body and connected to said keeper member to lock the same in its cable retaining keeper position.

* * * * *

UNITED STATES PATENT OFFICE

CERTIFICATE OF CORRECTION

Patent No. 4,055,973 Dated November 1, 1977

Inventor(s) Walter E. Best

It is certified that error appears in the above-identified patent and that said Letters Patent are hereby corrected as shown below:

Column 1, line 34, change "traverse" to --traverses--.

Column 4, line 50, change "and" to --end--;

line 65, change "corresponding" to --correspondingly--.

Column 5, line 39, change "on" to --to--.

Column 6, line 49 (Claim 4), change "member" to --members--.

Column 8, line 1 (Claim 14), change "boxes" to --bores--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*